US007609135B2

(12) United States Patent
Yang

(10) Patent No.: US 7,609,135 B2
(45) Date of Patent: Oct. 27, 2009

(54) SWITCHING APPARATUS WITH VOLTAGE SPIKE PREVENTION

(75) Inventor: Kei-Wean Calvin Yang, Beaverton, OR (US)

(73) Assignee: Tektronix, Inc., Beaverton, OR (US)

( * ) Notice: Subject to any disclaimer, the term of this patent is extended or adjusted under 35 U.S.C. 154(b) by 358 days.

(21) Appl. No.: 10/987,418

(22) Filed: Nov. 12, 2004

(65) Prior Publication Data

US 2005/0231307 A1 Oct. 20, 2005

Related U.S. Application Data

(60) Provisional application No. 60/562,636, filed on Apr. 14, 2004, provisional application No. 60/583,105, filed on Jun. 24, 2004.

(51) Int. Cl.
*H01H 53/00* (2006.01)

(52) U.S. Cl. ..... 335/4; 333/105

(58) Field of Classification Search ..... 335/4–5; 200/504; 333/101, 105–108, 258, 259, 262
See application file for complete search history.

(56) References Cited

U.S. PATENT DOCUMENTS 4,298,847 A * 11/1981 Hoffman ..... 333/105

* cited by examiner

*Primary Examiner*—Ramon M Barrera
(74) *Attorney, Agent, or Firm*—Bennet K. Langlotz; Thomas F. Leniban

(57) ABSTRACT

A switching apparatus has a conductive housing forming a chamber. The housing has an aperture enabling communication between the chamber and a housing exterior. A rod extends through the aperture, and has a first end within the chamber, and an opposed second end outside the chamber. The rod reciprocates over a range of motion between a first position in which a limited portion of the rod extends into the chamber, and a second position in which a greater portion of the rod extends into the chamber. The rod has a electrically insulative portion electrically isolating the first end from the second end, and has a conductive surface contacting the housing. A pair of electrical contacts are located in the chamber, and a shorting bar connected to the first end of the rod operates to bridge the contacts when the rod is in a selected position.

17 Claims, 4 Drawing Sheets

SWITCHING APPARATUS WITH VOLTAGE SPIKE PREVENTION

CLAIM FOR PRIORITY

The subject patent application claims priority from U.S. Provisional Patent Application Ser. No. 60/562,636, entitled, METHOD AND APPARATUS FOR ELIMINATION OF VOLTAGE TRANSIENT DURING SWITCHING OF AN RF RELAY (Yang) filed 14 Apr. 2004, and also from U.S. Provisional Patent Application Ser. No. 60/583,105, entitled, METHOD AND APPARATUS FOR ELIMINATION OF VOLTAGE TRANSIENT DURING SWITCHING OF AN RF RELAY (Yang) filed 24 Jun. 2004.

FIELD OF THE INVENTION

This invention relates to high isolation microwave frequency switching devices where signal routing is achieved via mechanical movement of conducting elements connected by an insulator.

BACKGROUND OF THE INVENTION

As electronics speed moves into the multi-gigahertz regime, component dimensions are shrinking commeasurably. This causes devices to be more sensitive to electrical over-stresses via accidental exposure to unintended voltages. When test and measurement instruments are of low bandwidth such as those state-of-the-art oscilloscopes from a few years ago, many ultra fast single incidence high voltage spikes are essentially undetectable and overlooked. Their presence however, may have caused mysterious unexplained device failures. As oscilloscope bandwidth continued to increase, those ultra fast single-incidence events can now be captured with relative ease. This has led to the discovery of many unexpected voltage spikes generated by some seemingly-harmless structures.

One such anomaly is an unexpected voltage-spiking problem common in 26 GHz mechanical relays. High bandwidth instruments often require signal routing with minimum distortion and insertion loss through different paths for various purposes such as, changing attenuation, filtering, gain controlling, time delaying, phase referencing, etc. Although solid-state switching devices have gained ground in signal switching applications, mechanical relays are still preferred for switching broadband microwave signals where minimum signal distortion, low on-state insertion loss, low off-state signal feed-through, and smooth impedance transitions throughout the signal rerouting are required. Such mechanical relays typically use a studded center (output) connector with as many moveable satellite strip lines as that relay's number of throws. Each of the satellite movable strip lines starts at its corresponding individual connector and ends at the center common connector, and is controlled by a push rod mechanism to place that strip line section, one-at-a-time, to complete the signal path between the center connector and the corresponding satellite connector. The entire strip line structure is completely contained in a fully enclosed Faraday cage.

An exemplary RF relay structure in the 26 GHz bandwidth range is represented by the DB Products (Carson, Calif.) model 2SE1T11JA relay. This relay has been found to produce up to ~20V peak 200 ps negative pulses each time the relay toggles. This spike voltage does not change polarity as one switches the relay back and forth.

SUMMARY OF THE INVENTION

A switching apparatus has a conductive housing forming a chamber. The housing has an aperture enabling communication between the chamber and a housing exterior. A rod extends through the aperture, and has a first end within the chamber, and an opposed second end outside the chamber. The rod reciprocates over a range of motion between a first position in which a limited portion of the rod extends into the chamber, and a second position in which a greater portion of the rod extends into the chamber. The rod has a electrically insulative portion electrically isolating the first end from the second end, and has a conductive surface contacting the housing. A pair of electrical contacts are located in the chamber, and a shorting bar connected to the first end of the rod operates to bridge the contacts when the rod is in a selected position.

DETAILED DESCRIPTION OF A PREFERRED EMBODIMENT

Figure 1:
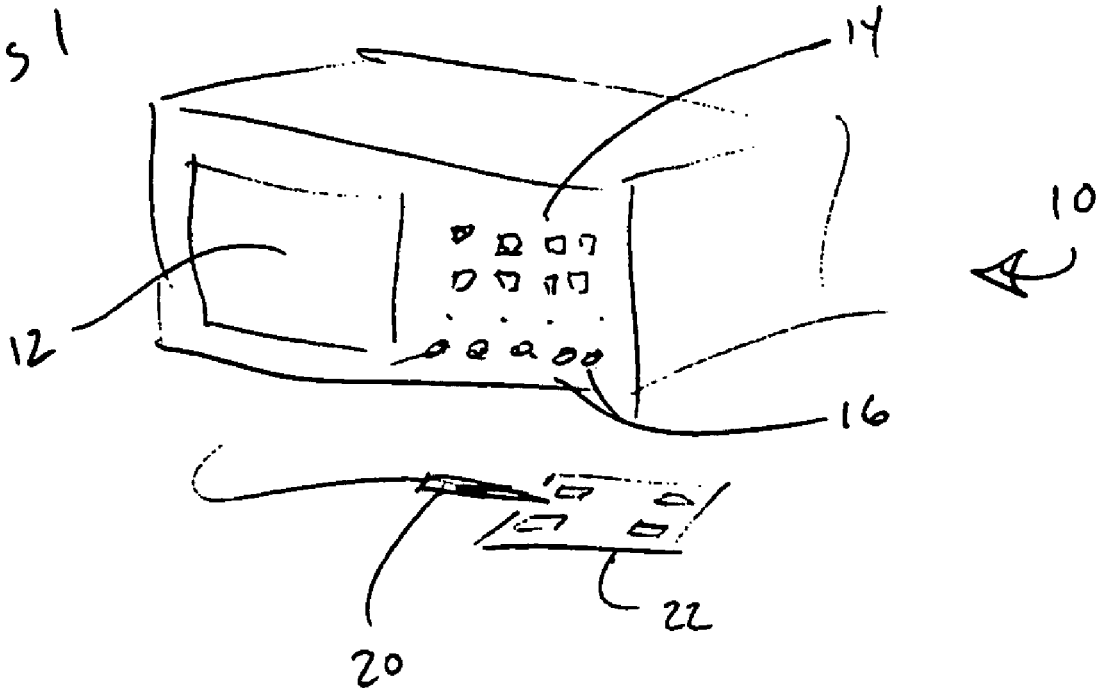
FIG. 1 shows a simplified illustration of an oscilloscope according to a preferred embodiment of the invention

FIG. 1 shows a Digital Storage Oscilloscope (DSO) 10 having a display screen 12, an array of controls 14, and a set of input connectors 16. The DSO includes internal processor circuitry (not shown) connected to the input for receiving a signal, and to the display for displaying the processed signal. The DSO includes internal memory for storing data, masks, and for storing operational software that provides tool modules for processing signals in various useful ways. The DSO includes a probe 20 connected to an input 16, and operable for making electrical contact with a device 22 under test. Other uses may employ cables connected directly from a cable connector on a device under test to the input 16.

Figure 2:
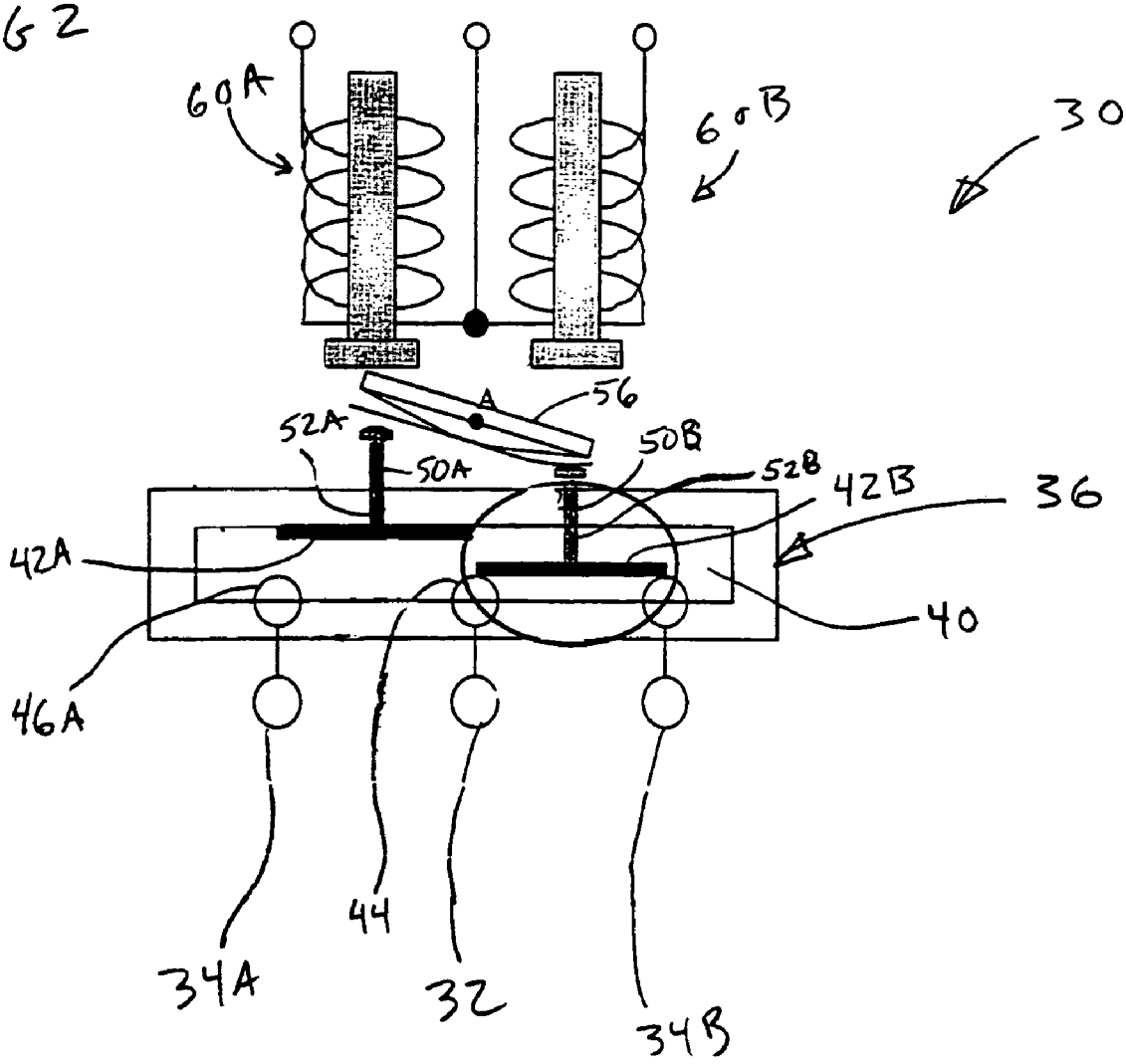
FIG. 2 shows a sectional view of a switching assembly according to the preferred embodiment.

FIG. 2 shows a radio frequency (RF) switching relay 30 employed within the DSO. The relay serves to direct a high frequency signal received on an input line 32 to one of two output lines 34A, 34B. The input and output lines extend from a metal faraday cage 36 defining a chamber 40. All switching occurs within the chamber so that a constant controlled impedance strip line environment can be established. This also prevents EMI (electromagnetic interference) from being emitted into the device surroundings.

Within the chamber a pair of shorting bars 42A, 42B serve to close or open connections between the input and the outputs. Bar 42A has opposed ends registered respectively with an input contact 44 connected to input line 32, and an output contact 46A connected to output line 34A (all input and output lines being electrically isolated from the cage at the push rod down position.) The bar 42A moves between a first open position (up position) in which the bar is spaced apart from the contacts 44 and 46A and a closed position. In the open position, the bar is in electrical contact with the housing wall and thus electrically grounded as shown in FIG. 2. In the closed position (down position) the bar contacts the contacts and thus electrically isolated from the chamber wall. Similarly, the other shorting bar 42B operates to open and close a connection between contacts 44 and 46B.

Each shorting bar is supported at its midsection by a respective cylindrical push-rod 50A, 50B. Each push rod is closely received in a respective circular aperture 52A, 52B in a major wall of the cage opposite the wall on which the contacts are mounted. Each pushrod is formed of a non-conductive dielectric material (except as detailed below) to prevent electrical continuity between the supported shorting bar and the rest of the supporting system. Each pushrod has a free end 54A, 54B extending away from the cage. A pivoting armature 56 pivots about an axis fixed with respect to the cage, with opposed ends registered with the free ends of the push rods through a leaf spring attached to it. The armature pivots about a point A to ensure that one and only one of the shorting bars is in the closed position at any time (except for momentary transitions.)

The armature is acted upon by a pair of solenoids 60A, 60B that each operate in response to an applied drive signal to bear on and pivot the armature to bear on and actuate a respective push rod to make a connection with the respective shorting bar.

In the prior art, the disclosed relay has entirely non-conductive pushrods, which leads to a problem addressed by the preferred embodiment. As the prior art push rods move up and down due to the pressure from the armature, negative triboelectricity static charges are generated from friction between the insulating push rod and the surrounding metals it contacts. This static charge on the push rod attracts positive charges on the originally neutral shorting bar as it departs from its open position and moves toward the contacts. Because of the initially neutral condition, the induced positive charge pushes the same amount negative charge to the opposite side of the shorting bar. As the shorting bar moves to contact the contact points, the equal potential law forces the net negative free charge out of the Faraday cage and a net negative charge spike is emitted through the contacts with which the shorting bar just made contact. Depending on which contact is established first, the majority of, or all of, the negative charge is dissipated through that connector and may be observable as a voltage spike. As the relay switches, the selected shorting bar to the open position, the shorting bar retracts to the top of the chamber and contacts the inner surface of the housing. Meanwhile, the corresponding push rod also retracts back into the chamber wall's through hole aperture where the flux lines emitted from its negative charges will now be terminated by the aperture wall instead of the shorting bar. The disappearance of the flux lines into the shorting bar releases those induced positive charges and transforms them into free charges. Upon the shorting bar's contact to the chamber wall, those positive charges again are immediately discharged to the chamber wall as the negative charges did to the contacts earlier and the process can repeat without attenuation.

Figure 3:
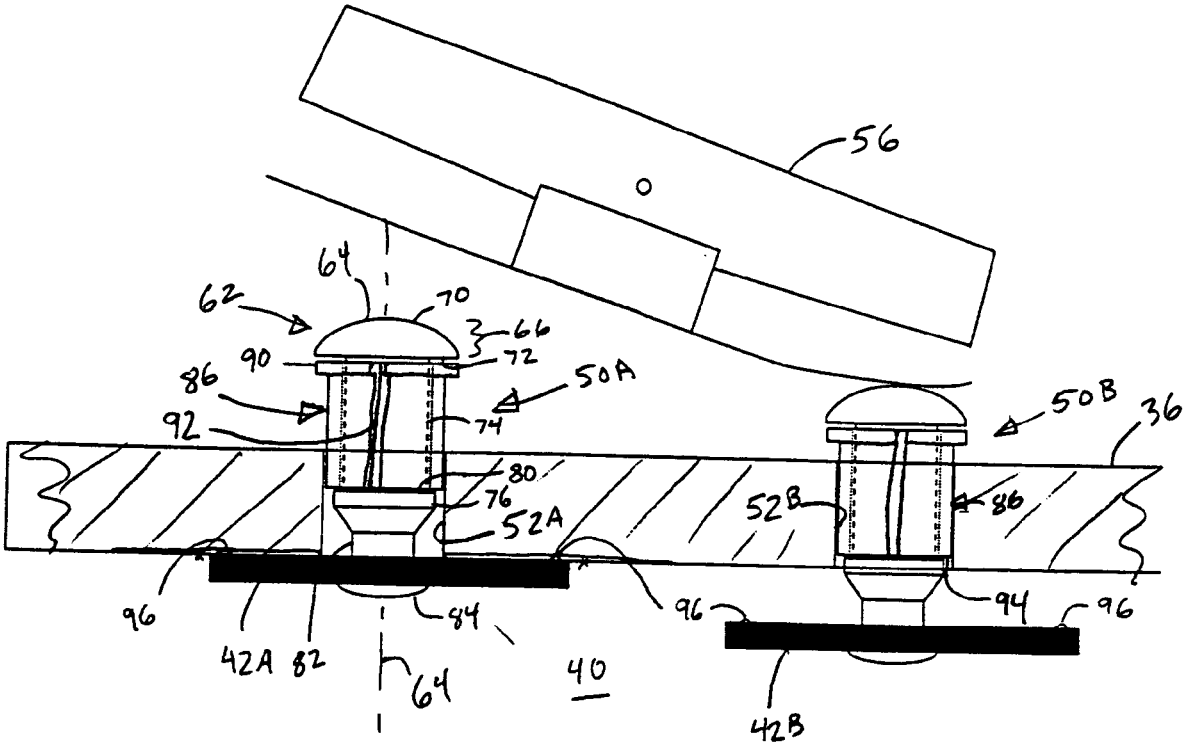
FIG. 3 shows an enlarged sectional view of a switching assembly according to the preferred embodiment.

FIG. 3 shows the details of how the preferred embodiment avoids generating this unwanted voltage spike. Each push rod 50A, 50B (referred to hereinafter without the letter suffix because the pushrod assemblies are identical) has a spindle portion 62 that is an elongated body centered on an axis 64 that also defines the respective bore 52. The spindle is an electrically insulating dielectric body with a first end 64 extending away from the cage 36, and an opposed second end within the chamber 40. The spindle has a head or cap portion 66 providing a rounded bearing surface 70 for the armature to act upon, and a flat shoulder 72 facing the cage. A first cylindrical portion 74 extends from the head, and has a diameter smaller than the head to provide for the shoulder 72. A second shoulder portion 76 extends from the first cylindrical portion 74, provides a shoulder 80 facing the head 66, and has a diameter slightly larger than the portion 74 and smaller than the bore 52. A tapered portion 80 of the second shoulder portion tapers to a second cylindrical portion 82, which receives the aperture of the shorting bar 42. A second head 84 having a larger diameter than the bar aperture secures the bar to the spindle.

The push rod 50 includes a metal sleeve 86 that closely encompasses the first cylindrical portion and is captured at its ends by shoulders 72 and 80, which have a larger diameter than the interior bore of the sleeve. The sleeve has a flange 90 at the end adjacent to the head 66, and the flange has a diameter greater that the cage bore 52 so that the flange can capture the upper end of a concentric coil spring that provides the restoring force to the push rod when its top surface 70 is not pressed down by the armature leaf spring (the shorting bar and contacts in the cage normally limit the range of motion). The sleeve may preferably include a slit 92 running from end-to-end. This not only facilitates assembly by allowing the sleeve to expand to be forced over the second shoulder portion 76, but is also useful to suppress a potential resonance mode that could absorb electrical energy from the passing microwave signals during operation at certain frequencies.

As shown in the right portion of FIG. 3, at the push rod down (closed) position, the sleeve 86 has a leading end 94 that nearly extends to the inner surface of the chamber 40 without extending into the chamber. This is limited by the shoulder 80, and avoids changing the performance of the cage due to changes in switching position, such as by disturbances to the transmission line environment in the cage, and signal reflections and increased insertion losses that might otherwise result.

In the preferred embodiment, the dielectric spindle 62 is formed of PCTFE, has a length of 0.205 inch a head 66 diameter of 0.125 inch, a first cylindrical portion 74 length of 0.150 inch, a diameter of 0.067 inch, and a second shoulder portion diameter of 0.0725 inch.

The cage aperture 52 has a diameter of 0.093 inch. The sleeve is formed of brass, and has an overall length of 0.155 inch, an inside diameter of 0.07 inch, a flange diameter of 0.125 inch, and a wall thickness of 0.010 inch The switch is designed to avoid any contact between the plastic portions of the push rod and the cage, so that no charge can be accumulated due to friction. All contact between the push rod assembly and the cage is metal-to-metal. To relieve some friction between the metal sleeves and their corresponding barrel walls, and also to dissipate any static charges that might ever start to accumulate on the dielectric surfaces, an imperfectly insulating (slightly conducting) material such as Progold (from Caig Labs, Poway, Calif.) is applied to the exposed dielectric surface as well as to the metal sleeve exterior and interior. In addition to lubricating the sleeves as they travel up and down the barrels, this also allows any charge on the dielectric surface to be dissipated to the cage before any substantial charge amount can accumulate.

In alternative embodiments, the sleeve may be functionally replaced by plating the first cylindrical portion with a metal surface that prevents contact with the cage by anything but the conductive plating. To provide the slot 92, the plastic spindle may have a recessed groove so that thin film deposition can not fill that gap and, which effectively forms an electrical discontinuity for resonance suppression purpose. Also, the shoulder 72 facing the outer surface of the cage may preferably be plated, as may any shoulder or corner at the leading edge of the dielectric portion where the spindle transitions to a smaller diameter where the surface is unplated and rebated away from the cage aperture surface. In a further alternative embodiment, the cage aperture may have a larger diameter portion adjacent the interior of the cage to avoid possible contact with the unplated portion of the pushrod. In a further alternative embodiment, the spindle need not be dielectric material over its entire length. The sleeve portion may be a solid metal bushing, with a dielectric isolator mechanically connecting and electrically isolating the bushing from the shorting bar.

Figure 4:
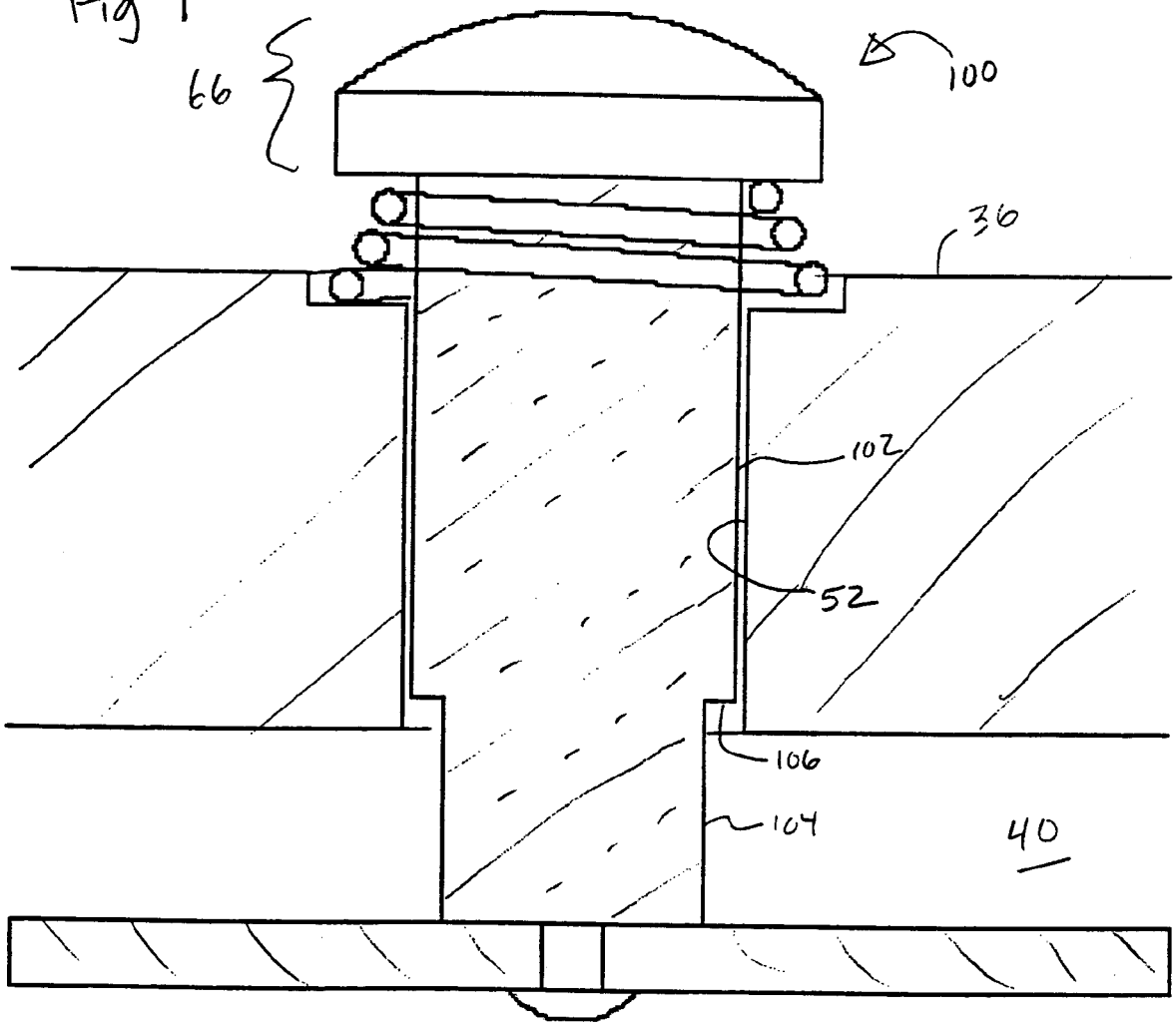
FIG. 4 shows an enlarged sectional view of a switching assembly according to an alternative embodiment.

In a further alternative embodiment suited for applications seeking lower cost and complexity, and with less sensitivity to the electrical discharge concerns discussed above, the metal sleeve is omitted and the diameter of the dielectric section 74 is extended to a cross sectional profile comparable to the outside diameter of the metal sleeve 86 shown in FIG. 3. As shown in FIG. 4, a spindle 100 has a main cylindrical portion 102 adjacent the head 66, and closely received in the bore 52. A cylindrical reduced diameter section 104 extends from the main portion 102, with adequate clearance to avoid contact with the bore wall 52.

A transition shoulder 106 between the main and reduced portions is positioned a limited distance form the head 66, so that at the down stroke position (when the corresponding contacts are shorted by shorting bar 42) the shoulder remains within the bore 52, and does not extend into the chamber 40. Similarly, the main portion 102 remains at least slightly recessed within the bore in all conditions. The whole push rod assembly is then coated with an imperfect insulating material such as a thin coating of 5% Progold such as discussed above. In this arrangement, the dielectric rod section that will enter the Faraday cage not only will not have an opportunity to generate triboelectricity, but also will dissipate any surface charges that may have been there via the finite conductivity of the coated material.

Surface charge is also significantly reduced for the upper section of the dielectric rod that does come in contact with the aperture wall because of the enhanced conductivity provided by the Progold coating. Surface charge may still be present at the surface of the spindle that rubs against the cage bore wall. However, any accumulated charge does not enter the Faraday cage cavity. As a result, all field lines originating from such dielectric rod surface charges are terminated by the grounded barrel wall, and no electric flux lines enter the contact chamber. This eliminates induced charges on the shorting bar and thus eliminates the voltage spiking phenomenon during relay switching.

In another alternative embodiment, the dielectric rod is made of a low but finite conductivity material of low dielectric loss and dielectric constant. Similar to the above arguments, voltage spiking can also be effectively suppressed.

While the above is discussed in terms of preferred and alternative embodiments, the invention is not intended to be so limited.

What is claimed is:

1. A switching apparatus comprising;

a conductive housing defining a chamber;

the conductive housing defining an aperture providing communication between the chamber and a housing exterior;

a rod extending through the aperture, and having a first end within the chamber, and an opposed second end outside the chamber;

the rod having a cap portion at the second end;

the rod being operable to reciprocate over a range of motion between a first position in which a limited portion of the rod extends into the chamber, and a second position in which a greater portion of the rod extends into the chamber;

the rod having a electrically insulative portion electrically isolating the first end from the second end;

the rod having a conductive surface contacting the housing;

a spring substantially surrounding the portion of the conductive surface of the rod not extending into the chamber, the spring being bounded by a lower surface of the cap, and a surface of the conductive housing;

a pair of electrical contacts in the chamber; and a shorting bar connected to the first end of the rod and operable to bridge the contacts when the rod is in a selected position; wherein when said rod is moved to said second position, said conductive surface remains outside of said chamber.

2. The apparatus of claim 1 wherein the aperture is a circular bore, and wherein the rod's conductive surface is a cylindrical surface.

3. The apparatus of claim 1 wherein the rod is an elongated dielectric body having a metallic surface about an intermediate portion.

4. The apparatus of claim 1 wherein the conductive surface is a metal sleeve.

5. A switching apparatus comprising;

a conductive housing defining a chamber;

the housing defining an aperture providing communication between the chamber and a housing exterior;

a rod extending through the aperture, and having a first end within the chamber, and an opposed second end outside the chamber;

the rod being operable to reciprocate over a range of motion between a first position in which a limited portion of the rod extends into the chamber, and a second position in which a greater portion of the rod extends into the chamber;

the rod having a electrically insulative portion electrically isolating the first end from the second end;

the rod having a conductive surface contacting the housing;

a pair of electrical contacts in the chamber; and a shorting bar connected to the first end of the rod and operable to bridge the contacts when the rod is in a selected position; wherein when said rod is moved to said second position, said conductive surface remains outside of said chamber;

wherein said conductive surface is a metal sleeve; and wherein the sleeve surrounds a dielectric portion, and including a compound of limited conductivity between the sleeve and the dielectric portion.

6. The apparatus of claim 1 wherein the conductive surface is an applied film of liquid.

7. The apparatus of claim 1 wherein the conductive surface is a metal coating.

8. The apparatus of claim 1 wherein the rod has a metal intermediate portion, and with a dielectric end portion at each end of the metal portion.

9. The apparatus of claim 1 wherein when the rod is moved to the second position, the conductive surface remains outside of the chamber.

10. The apparatus of claim 9 wherein when the rod is moved to the second position, the conductive surface is adjacent to an inner surface of the chamber.

11. The apparatus of claim 1 wherein the conductive surface defines a gap, such that it does not continuously encircle the rod.

12. An electronic instrument having a switching apparatus comprising;

a conductive housing defining a chamber;

the housing defining an aperture providing communication between the chamber and a housing exterior;

a rod extending through the aperture, and having a first end within the chamber, and an opposed second end outside the chamber;

the rod having a cap portion at the second end;

the rod being operable to reciprocate over a range of motion between a first position in which a limited portion of the rod extends into the chamber, and a second position in which a greater portion of the rod extends into the chamber;

the rod having a electrically insulative portion electrically isolating the first end from the second end;

the rod having a conductive surface contacting the housing;

a spring substantially surrounding the portion of the conductive surface of the rod not extending into the chamber, the spring being bounded by a lower surface of the cap, and a surface of the conductive housing;

a pair of electrical contacts in the chamber; and a shorting bar connected to the first end of the rod and operable to bridge the contacts when the rod is in a selected position; wherein when said rod is moved to said second position, said conductive surface remains outside of said chamber.

13. The instrument of claim 12 wherein the rod is an elongated dielectric body having a metallic surface about an intermediate portion.

14. The instrument of claim 12 wherein the conductive surface is a metal sleeve.

15. The instrument of claim 12 wherein the conductive surface is a metal coating.

16. The instrument of claim 12 wherein when the rod is moved to the second position, the conductive surface remains outside of the chamber.

17. The apparatus of claim 4, wherein the metal sleeve is substantially cylindrical, has a first end and a second end, and said sleeve defines a gap from said first end to said second end such that it does not continuously encircle said rod.

* * * * *